US006466171B1

(12) United States Patent
Sherman et al.

(10) Patent No.: US 6,466,171 B1
(45) Date of Patent: Oct. 15, 2002

(54) MICROSTRIP ANTENNA SYSTEM AND METHOD

(75) Inventors: Donald LeRoy Sherman, Smyrna, GA (US); Glenn Daniel Hopkins, Marietta, GA (US); Kerry Philip Pullen, Marietta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 09/946,580

(22) Filed: Sep. 5, 2001

(51) Int. Cl.[7] ..... H01Q 1/00
(52) U.S. Cl. ..... 343/700 MS; 343/893
(58) Field of Search ..... 343/700 MS, 846, 343/848, 893, 767, 770

(56) References Cited

U.S. PATENT DOCUMENTS 5,001,492 A * 3/1991 Shapiro et al. ..... 343/700 MS
5,005,019 A * 4/1991 Zaghloul et al. ..... 343/700 MS

OTHER PUBLICATIONS

Bahl, I.J. and P. Bhartia, Microstrip Antennas, Artech House, Dedham, Massachusetts, 1980.

Printed Circuit Transmission Line Architectures, first used on Mar. 8, 2000 in a Georgia Tech Research Institute Continuing Education Short Court entitled Phased Array Antennas.

Howell, J.Q., "Microstrip Anetnnas," IEEE AP–S International Symposium Digest, 1972 pp. 177–180.

Munson, R.E., "Conformal Microstrip Antennas and Microstrip Phased Arrays," IEEE Transactions on Antennas and Propagation, vol. AP–22, 1974, pp. 74–78.

Pozar, D.M., "Microstrip Antennas Aperture–Coupled to a Microstrip Line," Electronics Letters, vol. 21, 1985, pp. 49–50.

Pozar, D.M., and D. H. Schaubert, editors, Microstrip Antennas, IEEE Press, New York, 1995.

Sabban, A., "A new broadband stacked two–layer microstrip antennas," IEEE AP–s International Symposium Digest, 1983, pp. 63–66.

Zurcher, J.F., P. Gay–Balmaz, R. C. Hall, and S. Kolb, "Dual Polarized, Single and Double layer SSFIP Antennas," Microwave and Optics Technology Letters, vol. 7, 1994, pp. 406–410.

Zurcher, F. F., and F.E. Gardio, Broadband Patch Antennas, Artech House, Boston, Massachusetts, 1995.

* cited by examiner

*Primary Examiner*—Don Wong
*Assistant Examiner*—James Clinger
(74) *Attorney, Agent, or Firm*—Thomas, Kayden, Horstemeyer & Risley, LLP

(57) ABSTRACT

A microstrip antenna system and a method for communicating a dual polarized signal in the microstrip antenna system, is provided. An embodiment of the microstrip antenna system includes a stripline feed circuit (SFC) located in an SFC layer. The SFC layer lies between an upper stripline substrate and a lower stripline substrate. A lower ground plane lies below the lower stripline substrate. An upper ground plane lies above the upper stripline substrate. The embodiment reduces backward radiation.

31 Claims, 9 Drawing Sheets

MICROSTRIP ANTENNA SYSTEM AND METHOD

STATEMENT REGARDING FEDERALLY SPONSORED RESEARCH OR DEVELOPMENT

The U.S. government has a paid-up license in this invention and the right in limited circumstances to require the patent owner to license others on reasonable terms as provided for by the terms of agreement numbered F30602-96-2-0188 awarded by DARPA of U.S.

BACKGROUND OF THE INVENTION

1. Technical Field

The present invention generally relates to antennas, and more particularly to a microstrip antenna system and method for communicating a dual polarized signal in the microstrip antenna system.

2. Discussion of Related Art

Microstrip antennas have been used for various tasks. Significant development of microstrip antennas began in the early 1970's. Since then, extensive research and development effort has been expended on exploiting the advantageous features of microstrip antennas which includes, but is not limited to, planar configuration, light weight, low volume, low fabrication costs, and ease of fabrication using standard photolithography techniques.

In a conventional probe-fed antenna system, there are multiple stripline feed circuit layers and each stripline feed circuit layer has a substrate layer above and beneath. A hard-wired feed requires a sequential drill process through the multiple feed circuit layers and the substrate layers, thereby making the fabrication of the probe-fed antenna system complicated and expensive. Additionally, heat can cause thermal-expansion and potentially breakage of the substrate layers comprised in the probe-fed antenna system. The breakage of the substrate layers causes a breakage of the hard-wired feed, thereby resulting in a loss of electrical contact between the probe-fed antenna system and a circuit electrically coupled to the probe-fed antenna system. Moreover, a conventional microstrip configuration, of conventional microstrip antenna systems, is an open structure, thereby allowing radiation in a rearward or backward direction. The microstrip configuration is aperture-coupled. Back radiation is nearly always detrimental to performance of the conventional microstrip antenna systems. The microstrip configuration is also difficult to integrate into additional lower layers of a multi-layered printed circuit.

In a conventional microstrip antenna system by Pozar, as illustrated in Pozar D. M., "Microstrip Antenna Aperture-Coupled to a Microstrip-Line," *Electronics* Letters, Vol. 21, 1985, pp. 49–50, there is generally a single slot, which allows only single polarization and not dual polarization of a signal such as an electromagnetic signal. The conventional microstrip antenna system by Pozar is aperture-coupled. Adding a second slot orthogonal to the first slot and centered under a patch antenna, comprised in the microstrip antenna system by Pozar, is generally not possible since two microstrip feed circuits that are located beneath the slots cannot occupy the same space without electrically interfering with each other. Although, it is possible to move the second slot off center of the patch antenna and orthogonal to the first slot, doing so results in poor polarization performance and radiation pattern asymmetry. Hence, the microstrip antenna system by Pozar does not allow dual polarization of the signal. Furthermore, the microstrip antenna system by Pozar is a microstrip configuration, thereby allowing the first slot to radiate the signal in a rearward or backward direction, which is nearly always detrimental to performance of the microstrip antenna system. Additionally, a conventional microstrip antenna system by Zurcher, as illustrated in Zurcher, J. F., P. Gay Balmaz, R. C. Hall, and S. Kolb, "Dual Polarized, Single and Double Layer SSFIP Antennas," *Microwave and Optics Technology Letters,* Vol. 7, 1994, pp. 406–410, comprises a microstrip configuration; thereby resulting in backward radiation that can interfere with signals from electrical systems electrically coupled to the microstrip antenna system.

Thus, a heretofore-unaddressed need exists in the industry to address the aforementioned deficiencies and inadequacies.

SUMMARY OF THE INVENTION

The present invention overcomes the inadequacies and deficiencies of the prior art as discussed herein by providing a microstrip antenna system and a method for communicating a dual polarized signal in a microstrip antenna system. An embodiment of the microstrip antenna system includes a stripline feed circuit (SFC) located in an SFC layer. The SFC layer lies between an upper stripline substrate and a lower stripline substrate. A lower ground plane lies below the lower stripline substrate. An upper ground plane lies above the upper stripline substrate.

A preferred embodiment of the microstrip antenna system also comprises an SFC located in an SFC layer. The SFC layer is located between an upper stripline substrate and a lower stripline substrate. A lower ground plane is located below the lower stripline substrate. An upper ground plane is located above the upper stripline substrate. Four slots are located in the upper ground plane. A lower microstrip substrate is located between a lower microstrip patch antenna and the upper ground plane. An upper microstrip substrate is located between an upper microstrip patch antenna and the lower microstrip patch antenna.

A method for communicating a dual polarized signal in the microstrip antenna system comprises the steps of feeding a dual polarized signal from the SFC to the upper stripline substrate, and propagating the dual polarized signal from the upper stripline substrate to the upper ground plane. Another method for communicating a dual polarized signal in the microstrip antenna system comprises the steps of receiving a dual polarized signal from a propagation medium to the upper ground plane, propagating the dual polarized signal from the upper ground plane to the upper stripline substrate and further propagating the dual polarized signal from the upper stripline substrate to the SFC.

Other features and advantages of the present invention will be or become apparent to one with skill in the art upon examination of the following drawings and detailed description. It is intended that all such additional features and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT(S)

Figure 1A:
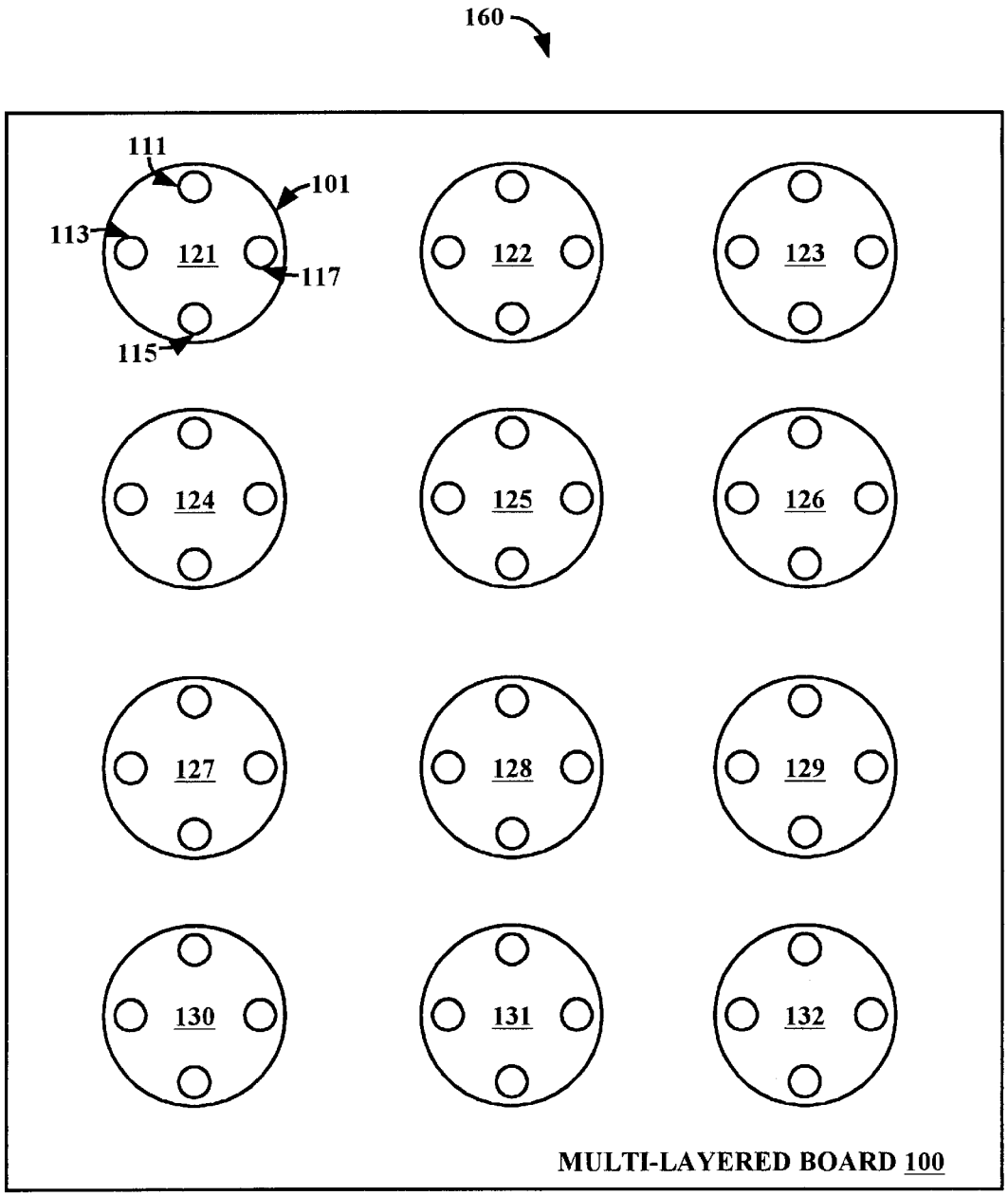
FIG. 1A (PRIOR ART)
FIG. 1A is a top view of a prior art probe-fed antenna system.

Turning now to the figures, where like reference numerals designate corresponding parts throughout the figures, FIG. 1A is a top view of a prior art probe-fed antenna system 160. As illustrated by FIG. 1A, the antenna system 160 comprises one or more patches 121–132 that are located on a conventional multi-layered board 100. The patch 121 comprises four pins, 111, 113, 115, and 117 for receiving and transmitting a signal, although the number of pins may differ. Each of the patches 122–132 also comprises four pins.

Figure 1B:
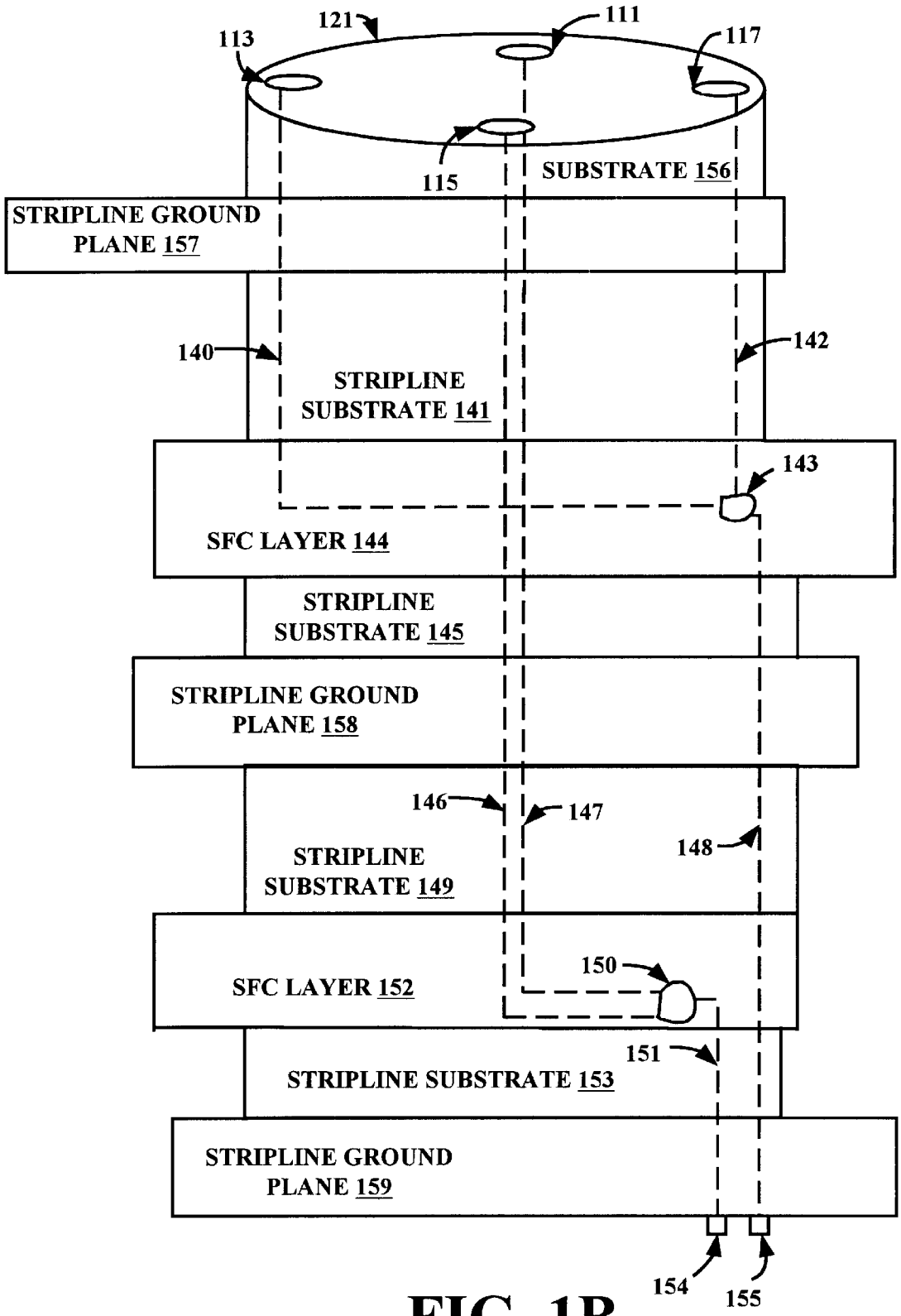
FIG. 1B (PRIOR ART)
FIG. 1B is a side view of the prior art probe-fed antenna system of FIG. 1A.

FIG. 1B is a side view of the prior art probe-fed antenna system 160 of FIG. 1A. Each of the pins 111, 113, 115, 117 on the patch 121 are hard-wired, where a hard wire 140 connects pin 113 to an SFC 143. A hard wire 142 connects pin 117 to the SFC 143. A hard wire 146 connects pin 115 to an SFC 150 and a hard wire 147 connects the pin 111 to the SFC 150. Furthermore, a fifth hard wire 148 connects the SFC 143 to a spigot 155, and a hard wire 151 connects the SFC 150 to a spigot 154. Connection of the hard wires 140, 142, and 146–147 to the SFCs 143, and 150, is referred to as a hard-wired feed since hard wires 140, 142, and 146–147 feed the SFCs 143, and 150, respectively.

The hard-wired feed generally requires a sequential drill process through a substrate 156, a stripline ground plane 157, a stripline substrate 141, an SFC layer 144, a stripline substrate 145, a stripline ground plan 158, a stripline substrate 149, an SFC layer 152, a stripline substrate 153, and a stripline ground plane 159. Moreover, although the probe-fed antenna system 160 provides dual polarization and a wide frequency bandwidth, it requires a set of layers, thereby making the sequential drill process difficult. Typically, the stripline substrate 141 lies above and the stripline substrate 145 lies below the SFC layer 144. The stripline substrate 149 lies above and the stripline substrate 153 lies below the SFC layer 152. Furthermore, the SFC 143 and the SFC 150 generally are located in two separate layers, namely, the SFC layer 144, and the SFC layer 152, respectively. Unfortunately, having multiple layers, drilling through each layer, placing the SFC 143 on the SFC layer 144 and the SFC 150 on the SFC layer 152, makes the fabrication of the probe-fed antenna system 160 complicated and expensive.

Additionally, heat can cause the substrates to expand or bend, thereby resulting in breakage of any of the hard wires 140, 142, 146, 147, 148, or 151. This can cause a loss of electrical contact between the patch 121 and either the first spigot 154 or the second spigot 155.

Figure 2A:
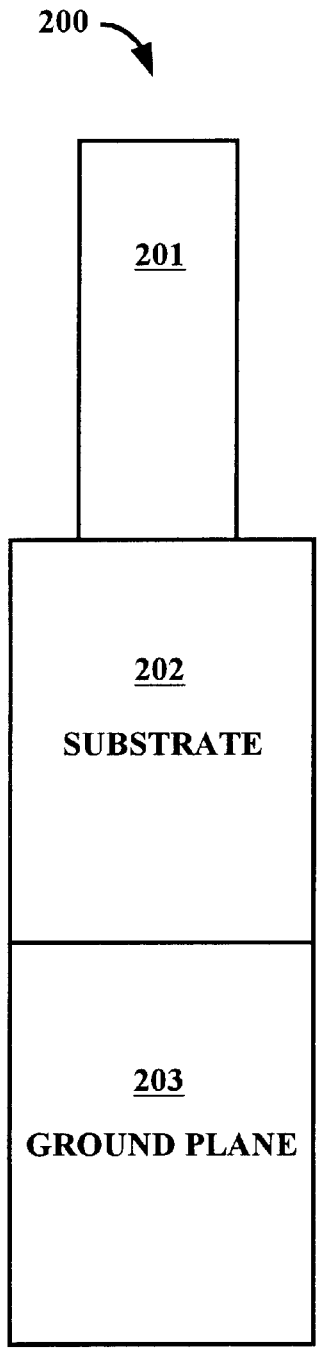
FIG. 2A (PRIOR ART)
FIG. 2A is a top-down view of a prior art microstrip configuration.
Figure 2B:
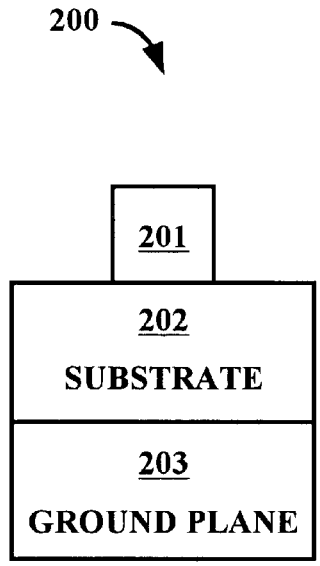
FIG. 2B (PRIOR ART)
FIG. 2B is a side view of the prior art microstrip configuration of FIG. 2A.

FIG. 2A is a top-down view of a prior art microstrip configuration 200. FIG. 2B is a side view of the prior art microstrip configuration 200 of FIG. 2A. A substrate 202 lies below a microstrip feed circuit layer 201. A ground plane 203 lies below the substrate 202. The microstrip configuration 200 is an open structure, thereby allowing a slot (not shown) that is located above the microstrip feed circuit layer 201, to radiate in a rearward or backward direction. Back radiation is nearly always detrimental to performance of an antenna (not shown) comprised in the microstrip configuration 200. The microstrip configuration 200 is also difficult to integrate into additional lower layers of a multi-layer printed circuit (not shown).

Figure 3:
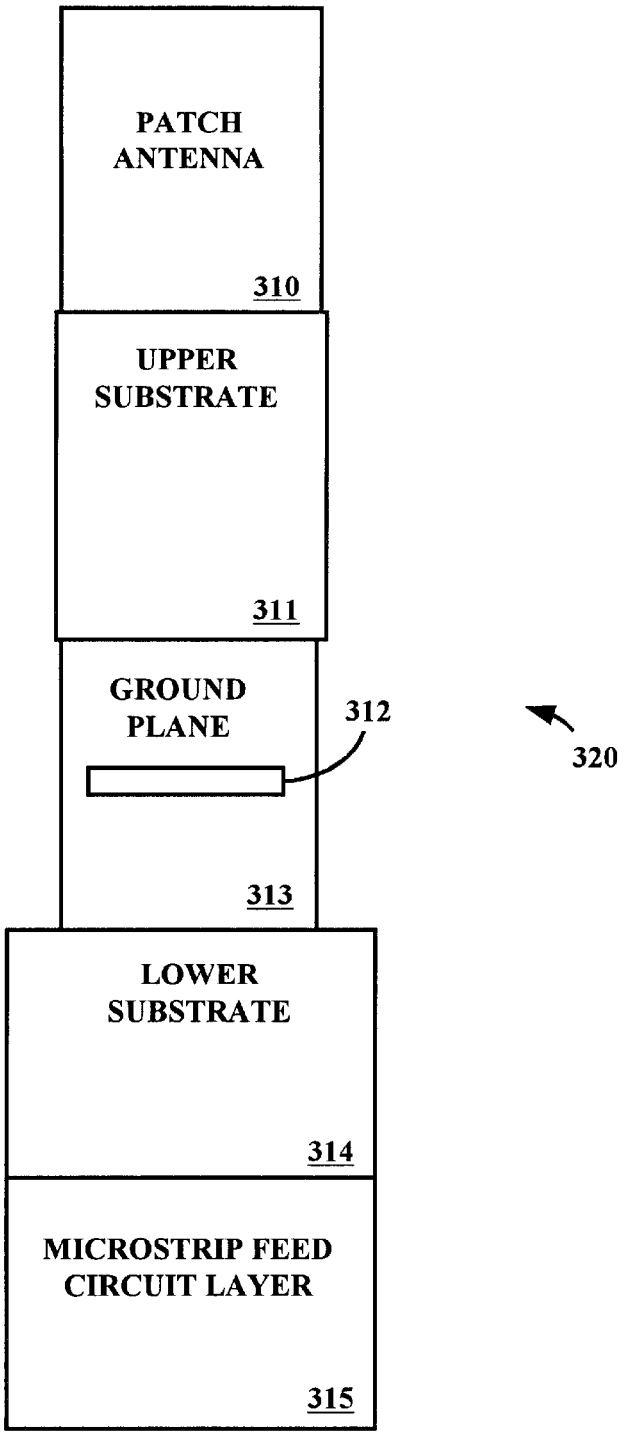
FIG. 3 (PRIOR ART)
FIG. 3 is a prior art microstrip antenna system.

In a conventional microstrip antenna system 320 by Pozar, illustrated in FIG. 3, a patch antenna 310 lies on the top of an upper substrate 311 that is located above a ground plane 313. A microstrip feed circuit layer 315 lies below a lower substrate 314 that is located below the ground plane 313. A slot 312 is located in the ground plane 313 and is centered under the patch antenna 310. The microstrip antenna system 320 by Pozar presents a slot coupled approach of coupling from a microstrip feed circuit (not shown) on the microstrip feed circuit layer 315 through the slot 312.

Unfortunately, the slot-coupled approach is limited in numerous ways, two of which are provided below. A first limitation is that the single first slot 312 allows only single polarization. Adding a second orthogonal polarization in an exact same manner that is allowed by the slot 312, but rotated by 90°, is generally not possible, since two microstrip feed circuits (not shown) that are located on the microstrip feed circuit layer 315, would have to simultaneously occupy the same space without electrically interfering with each other. It is possible to move the first slot 312 off-center of the patch antenna 310, making room for a second orthogonal slot (not shown), rotated 90°, and off-center of the patch antenna 310. Unfortunately, doing so results in an asymmetric field distribution on a microstrip patch radiator (not shown) comprised in the microstrip patch antenna system 320 by Pozar, thereby resulting in asymmetric radiation patterns and generally poor polarization performance. Hence, the microstrip antenna system 320 by Pozar does not allow dual polarization of the signal.

A second limitation, of the microstrip antenna system 320 by Pozar, is that a feed architecture that comprises the microstrip feed circuit layer 315 and the lower substrate 314 is constructed in a microstrip configuration. As stated above with reference to FIGS. 2A and 2B, a microstrip configuration is an open structure, thereby allowing the slot 312 to radiate the signal in a rearward or backward direction. Back radiation is nearly always detrimental to performance of the patch antenna 310.

"A Two-Substrate Dual Polarized Aperture-Coupled Patch," 1996 IEEE Antennas and Propagation Symposium, pp. 1544–1547, provides a conventional antenna system that generates symmetric radiation patterns. However, the antenna system is a microstrip configuration, thereby allowing back radiation. Moreover, the antenna system comprises two microstrip feed circuits, thereby requiring two printed circuit layers, one printed circuit layer for each microstrip feed circuit.

Additionally, a prior art microstrip antenna system by Zurcher comprises four slots that allow dual polarization of the signal. A gap between the four slots allows routing of a microstrip feed circuit located between the slots. Two microstrip feed circuits symmetrically feed the four slots, thereby obtaining symmetric radiation patterns and improving polarization performance. Unfortunately, the microstrip antenna system by Zurcher implements the microstrip configuration 200, as illustrated in FIGS. 2A and 2B, and therefore it suffers from the same backward radiation that the microstrip antenna system by Pozar, in FIG. 3, suffers. The backward radiation can interfere with signals related to electrical systems electrically coupled to the microstrip antenna system by Zurcher.

Figure 4A:
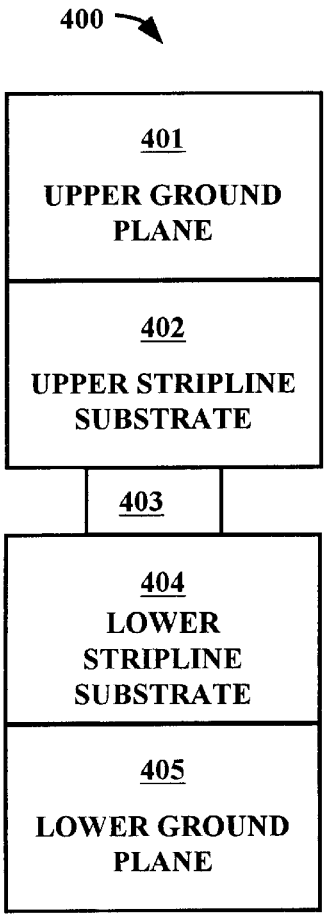
FIG. 4A is a side view of a stripline configuration of a microstrip antenna system.
Figure 4B:
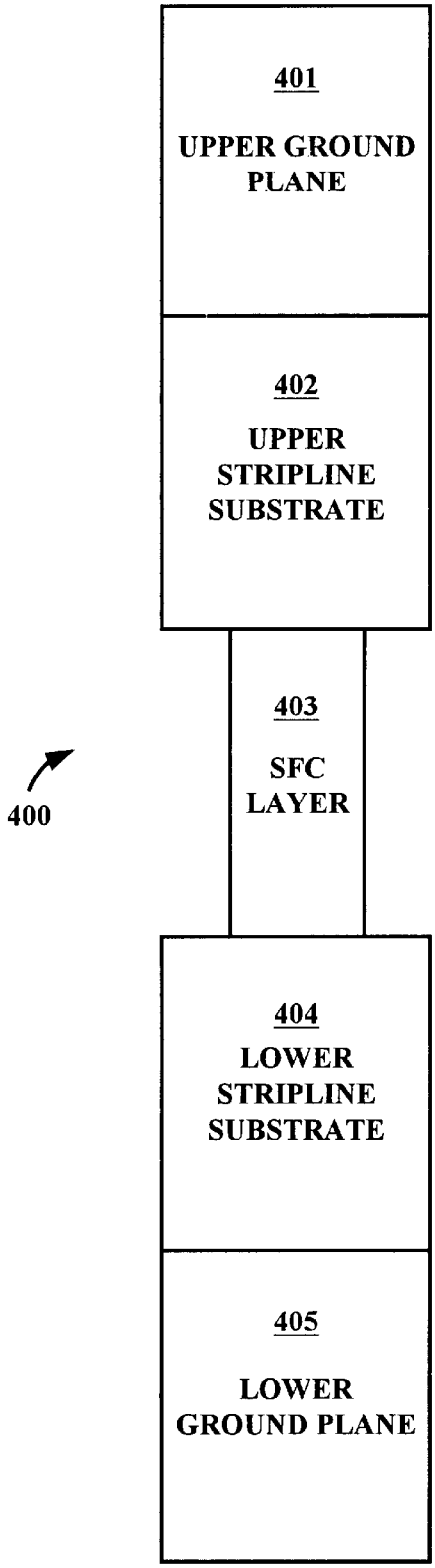
FIG. 4B is a top-down view of the stripline configuration of the microstrip antenna system of FIG. 4A.

In accordance with the present invention, FIG. 4A is a side view of a stripline configuration of a microstrip antenna system 400. FIG. 4B is a top-down view of the stripline configuration of the microstrip antenna system 400 of FIG. 4A. In both figures, an SFC layer 403 is located between an upper stripline substrate 402 and a lower stripline substrate 404. An upper ground plane 401 is located above the upper stripline substrate 404. A lower ground plane 405 is located below the lower stripline substrate 404.

Preferably, the upper ground plane 401, the upper stripline substrate 402, the SFC layer 403, the lower stripline substrate 404, and the lower ground plane 405, in FIGS. 4A and 4B, referred to collectively as the layers, are centered with respect to each other. However, the layers may not be centered with respect to each other.

Furthermore, the layers can be electrically coupled to each other, be glued to each other, fastened to each other with screws, or coupled to each other by any method known to people having ordinary skill in the art. Moreover, the SFC layer 403 can be made of any material including, but not limited to, solid aluminum, sheet steel, fiberglass, or any other material known to people having ordinary skill in the art. The upper and the lower ground planes 401 and 405 can be made of materials including, but not limited to, metals such as aluminum. Examples of the upper and the lower ground planes 401 and 405 are a natural surface such as the earth or sea surface, an artificial surface such as a roof of a motor vehicle, and a specially designed surface such as a disc of a discone antenna. The upper and the lower stripline substrates 402 and 404 can be made of any material such as, for instance, ceramic, gallium arsenide, or polytetrafluoroethylene (PTFE).

Figure 5A:
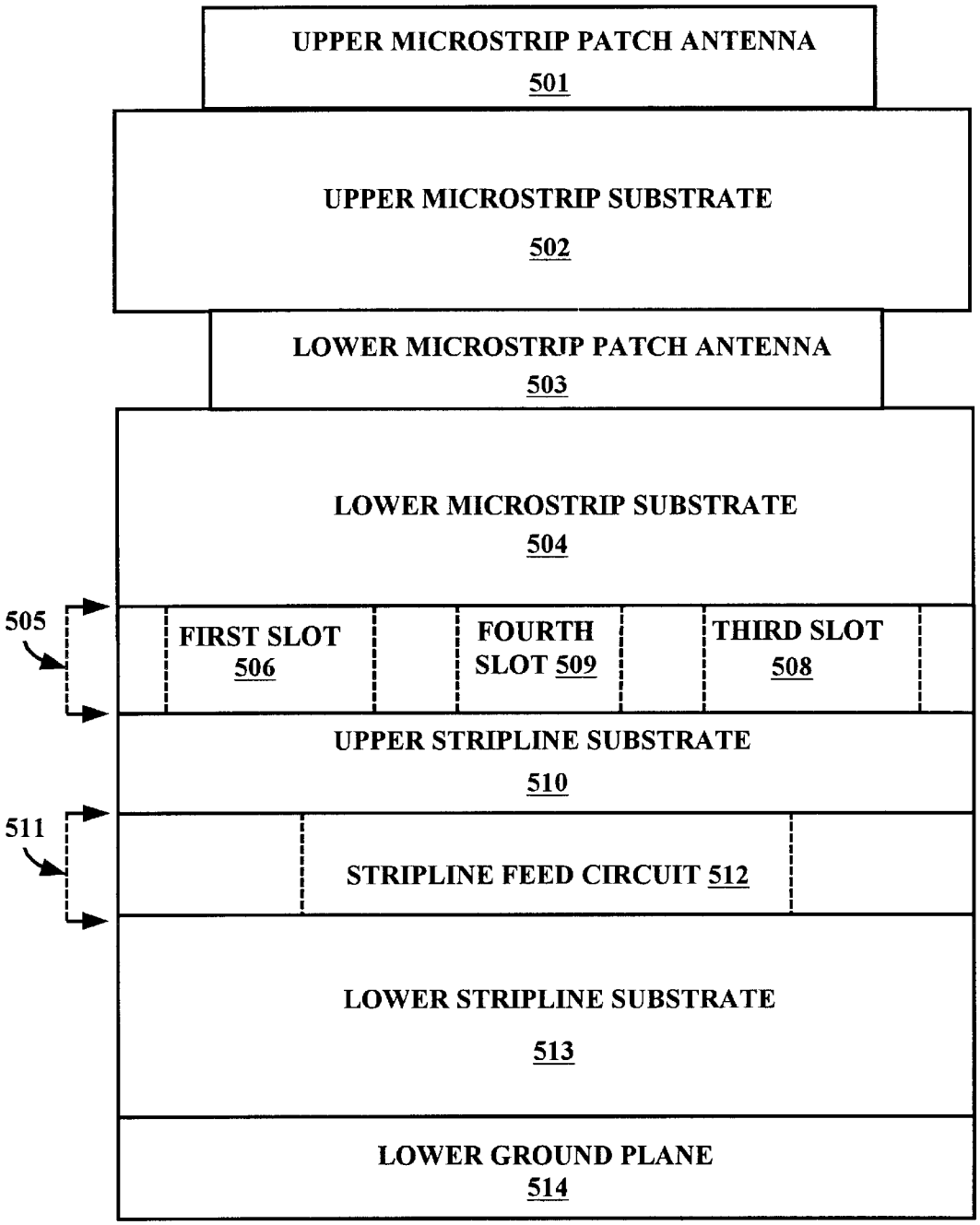
FIG. 5A is a side view of a preferred embodiment of the microstrip antenna system of FIGS. 4A and 4B.
Figure 5B:
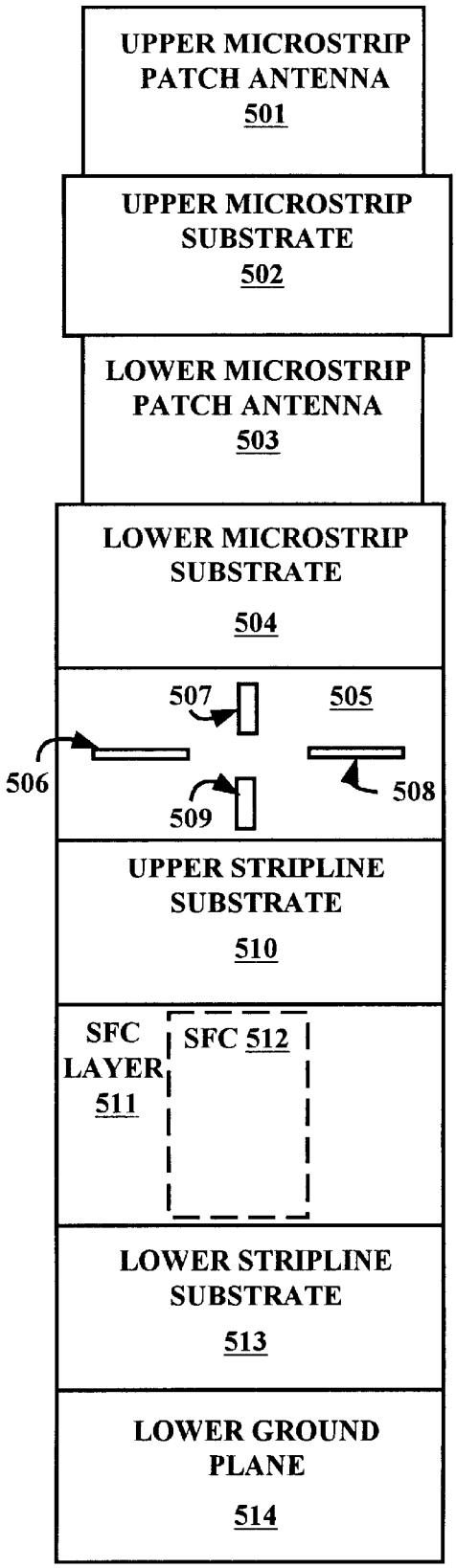
FIG. 5B is a top-down view of the microstrip antenna system of FIG. 5A.

FIG. 5A is a side view of a preferred embodiment of the microstrip antenna system 400 of FIGS. 4A and 4B. FIG. 5B is a top-down view of the microstrip antenna system of FIG. 5A. In both figures, an SFC layer 511 lies between an upper stripline substrate 510 and a lower stripline substrate 513. An upper ground plane 505 is located above the upper stripline substrate 510 and a lower ground plane 514 is located below the lower stripline substrate 513. The upper ground plane 505, the upper stripline substrate 510, the stripline feed circuit layer 511, the lower stripline substrate 513, and the lower ground plane 514 form a stripline configuration. The stripline configuration is an electromagnetically shielded architecture. To explain, the lower stripline substrate 513 and the lower ground plane 514 form a shield that significantly reduces backward radiation produced by an antenna. A lower microstrip patch antenna 503, or an upper microstrip patch antenna 501 can act as the antenna. A reduction of the backward radiation increases efficiency of the antenna.

The upper microstrip patch antenna 501, an upper microstrip substrate 502, the lower microstrip patch antenna 503, a lower microstrip substrate 504, the upper ground plane 505, the upper stripline substrate 510, the SFC layer 511, the lower stripline substrate 513, and the lower ground plane 514 can be electrically coupled to each other, be glued to each other, fastened to each other with screws, or coupled to each other by any method known to people having ordinary skill in the art.

Furthermore, the SFC layer 511, the upper microstrip patch antenna 501, and the lower microstrip patch antenna 503 can be made of any material including, but not limited to, solid aluminum, sheet steel, or fiberglass. Moreover, the upper and the lower ground planes 505 and 514 can be made of any metal, such as, aluminum, or any other material known to people having ordinary skill in the art. Furthermore, the upper and the lower stripline substrates 510 and 513 can be made of any material including, but not limited to, ceramic, gallium arsenide, or polyethylene therephtalate. Additionally, the upper microstrip substrate 502, the lower microstrip substrate 504, the upper ground plane 505, the upper stripline substrate 510, the lower stripline substrate 513, and the lower ground plane 514 improve the efficiency of the upper and the lower microstrip patch antennas 501 and 503. Efficiency of the upper and the lower microstrip patch antennas 501 and 503 accounts for the following losses: (1) reflection because of mismatch between a feeding transmission line and the antennas and (2) conductor and dielectric losses.

The electromagnetically shielded architecture allows placement of the microstrip antenna system of FIGS. 4A, 4B, 5A, and 5B on objects, including but not limited to, an airplane, a building, a house, or a car. A reason for the allowance is that the electromagnetically shielded architecture isolates any electrical systems electrically coupled to the microstrip antenna system of FIGS. 4A, 4B, 5A, and 5B, thereby reducing the probability of coupling energy between the electrical systems and the microstrip antenna system of FIGS. 4A, 4B, 5A, and 5B.

The upper ground plane 505 comprises four slots, a first slot 506, a second slot 507, a third slot 508, and a fourth slot 509. In FIG. 5A, the second slot 507 is behind the fourth slot 509, and therefore is not shown. The second slot 507 is located orthogonal to and clockwise to the first slot 506. The third slot 508 is located orthogonal to and is clockwise to the second slot 507. The fourth slot 509 is located orthogonal to and is in a clockwise direction from the third slot 508. In the preferred embodiment of the microstrip antenna system of FIGS. 5A and 5B, the slots are rectangular. However, the slots can be of shapes including, but not limited to, circular, square, dog bone, or any other shape known to people having ordinary skill in the art. Nevertheless, generally, the four slots are of such a size and shape that they avoid any overlap with an SFC 512 except in a very small, controlled area. The SFC layer 511 comprises the SFC 512.

Additionally, the first slot 506 and the third slot 508 are arranged such that they are centered above the upper stripline substrate 510. The second slot 507 and the fourth slot 509 are also centered above the upper stripline substrate 510. The arrangement of the four slots 506–509 allows the microstrip antenna system, of FIGS. 5A and 5B, to offer symmetric radiation patterns, improve polarization purity, and reduce cross-talk between each linear polarization. Moreover, the four slots 506–509 provide an ability to function with any polarization including, but not limited to, a dual polarization of a signal. The signal can be any type of signal including, but not limited to an electromagnetic signal of any frequency or any other signal known to people having ordinary skill in the art. The four slots 506–509 facilitate the dual polarization of the signal since two of the four slots are used for each linear polarization.

The upper microstrip patch antenna 501 is located above the upper microstrip substrate 502. The lower microstrip patch antenna 503 is located below the upper microstrip substrate 502 and above the lower microstrip substrate 504. The lower microstrip substrate 504 is located above the upper ground plane 505. The upper microstrip patch antenna 501 and the upper microstrip substrate 502 are in a microstrip configuration. Moreover, the lower microstrip patch antenna 503 and the lower microstrip substrate 504 are in a microstrip configuration. Any kind of antenna known to people having ordinary skill in the art can be used instead of the upper microstrip patch antenna 501 and the lower microstrip patch antenna 503. Furthermore, an array of antennas can be used in place of the upper microstrip patch antenna 501 or the lower microstrip patch antenna 503.

Each of the upper microstrip patch antenna 501 and the lower microstrip patch antenna 503 is essentially a resonant structure that can be thought of as a planar dipole, with two or more resonant modes. Basic radiation mechanism and implementation of utility of the upper microstrip patch antenna 501 and the lower microstrip patch antenna 503 has not changed since the inception of microstrip patch antennas. The upper microstrip patch antenna 501, as well as the lower microstrip patch antenna 503 have inherently narrow bands of frequency operation because they are resonant cavity devices. Therefore, a majority of the research devoted to antennas in the past two decades has focused on techniques for feeding the upper microstrip patch antenna 501 and the lower microstrip patch antenna 503, with a goal of improving frequency bandwidth of the microstrip antenna system. One such technique presented by Sabban, illustrated in Sabban, A., "A new broadband stacked two-layer microstrip antenna," *IEEE AP-S Internation Symposium Digest,* 1983, pp. 63–66, involves stacking two patch antennas, which can be tuned at different frequencies. The technique is called a stacked-patch approach, and is utilized by the preferred embodiment of FIGS. 5A and 5B. However, the upper microstrip patch antenna 501, the upper microstrip substrate 502, the lower microstrip patch antenna 503, and the lower microstrip substrate 504 are not requisite components of the microstrip antenna system of FIGS. 5A and 5B.

The SFC 512 is located in a single SFC layer 511 to avoid the costs, complications, time, and effort associated with the probe-fed antenna system 160 of FIGS. 1A and 1B. As stated with reference to the prior art, in the probe-fed antenna system 160 of FIGS. 1A and 1B, the SFC 143 and the SFC 150 are located on two separate layers, the SFC layer 144, and the SFC layer 152. This requires drilling through a set of layers, the SFC layer 144 and the SFC layer 152. Furthermore, the stripline substrate 141 is located above and the stripline substrate 145 is located below the SFC layer 144. Similarly, the stripline substrate 149 is located above and the stripline substrate 153 is located below the SFC layer 152. This generally requires additional drilling through the stripline substrate 141, the stripline substrate 145, the stripline substrate 149, and the stripline substrate 153. Furthermore, there is drilling through the substrate 156, and the stripline ground planes 157–159. There is drilling through the substrate 156, the stripline ground planes 157–159, and the stripline substrates 141, 145, 149, and 153 to connect the spigots 154 and 155 to the patch 121. Contrarily, in accordance with the preferred embodiment of the invention, in the microstrip antenna system 400 of FIGS. 4A and 4B, generally, there is no drilling involved through the different layers of FIGS. 4A and 4B.

Moreover, since the SFC 512, of FIGS. 5A and 5B, is located on a single stripline assembly, fewer substrate layers are required in the microstrip antenna system of FIGS. 5A and 5B, as compared to the probe-fed antenna system 160 of FIGS. 1A and 1B. A reason is that in the probe-fed antenna system 160 of FIGS. 1A and 1B, it is difficult to physically place the SFC 143 and the SFC 150 in a single layer. This difficulty of placing the SFC 143 and the SFC 150 into a single layer results in an additional stripline assembly, the SFC layer 152, thereby further resulting in two additional substrate layers, the stripline substrate 149 and the stripline substrate 153. Contrarily, in the microstrip antenna system of FIGS. 5A and 5B, it is physically possible to place the SFC 512 on a single SFC layer 511. Hence, placement of the SFC 512 on a single SFC layer 511 avoids the costs, complications, effort and time associated with multiple layers in the probe-fed antenna system 160 as is shown by the prior art of FIGS. 1A and 1B.

Additionally, the microstrip antenna system of FIGS. 5A and 5B avoids a probability of breakage of hard wires associated with the probe-fed antenna system 160 of FIGS. 1A and 1B. A reason for this avoidance is that there is no hard wire connecting the SFC 512 to the lower microstrip patch antenna 503 or the upper microstrip patch antenna 501. Hence, generally there is no risk of breakage of an electrical contact caused by thermal expansion when heat is applied to the microstrip antenna system of FIGS. 5A and 5B.

Moreover, the microstrip configuration 200 of FIGS. 2A and 2B is very difficult to integrate into additional lower layers of a multi-layer printed circuit (not shown) of the microstrip antenna system of FIGS. 4A, 4B, 5A and 5B. Contrarily, the microstrip antenna system of FIGS. 4A, 4B, 5A and 5B can be integrated as part of a multi-layer printed circuit board. The multi-layer printed circuit board can house any number of devices, including control devices like phase shifters and attenuators, transmit power amplifiers, low-noise receive amplifiers, digital control circuits, prime power distribution networks, and RF beam-forming combiners for use in array configurations.

In the preferred embodiment of the microstrip antenna system of FIGS. 5A and 5B, the upper stripline substrate 510 is less thick than the lower stripline substrate 513. Furthermore, the upper stripline substrate 510 has a different dielectric constant than the lower stripline substrate 513. Making the upper stripline substrate 510 thinner and of a different dielectric constant than the lower stripline substrate 513 helps improve the frequency bandwidth of the microstrip antenna system of FIGS. 5A and 5B. The frequency bandwidth of the microstrip antenna system preferably ranges from 1% to 50%. Of course, the frequency bandwidth may fall within a different range.

The upper stripline substrate 510 may have the same or different thickness as that of the lower stripline substrate 513, and the upper stripline substrate 510 may have the same dielectric constant as that of the lower stripline substrate 513. Thickness of the upper stripline substrate 510 may range from 0.003 to 3.000 inches. Thickness of the lower stripline substrate 513 may range from 0.005 to 12.000 inches. Also, the dielectric constant of the upper and the lower stripline substrates 510 and 513 may range from 1.0 to 100. It should be noted that the above-mentioned ranges may differ from those provided hereinabove.

Furthermore, the upper stripline substrate 510, the lower stripline substrate 513, the upper microstrip substrate 502, and the lower microstrip substrate 504 can be made of any dielectric material, including, but not limited to, Teflon® by DuPont company, semi-conductor, fiberglass, air, or any other material known to people having ordinary skill in the art. Furthermore, the upper microstrip patch antenna 501, the upper microstrip substrate 502, the lower microstrip patch antenna 503, the lower microstrip substrate 504, the upper ground plane 505, the upper stripline substrate 510, the SFC layer 511, the lower stripline substrate 513 and the lower ground plane 514 can be of any shape or size known to people having ordinary skill in the art. Moreover, each of the upper microstrip patch antenna 501, the upper microstrip substrate 502, the lower microstrip patch antenna 503, the lower microstrip substrate 504, the upper ground plane 505, the upper stripline substrate 510, the SFC layer 511, the lower stripline substrate 513, and the lower ground plane 514 can be planar or curved.

Preferably, the upper microstrip patch antenna 501, the upper microstrip substrate 502, the lower microstrip patch antenna 503, the lower microstrip substrate 504, the upper ground plane 505, the upper stripline substrate 510, the SFC layer 511, the lower stripline substrate 513, and the lower ground plane 514, referred to collectively as the layers, are centered with respect to each other. However, the layers may not be centered with respect to each other.

Figure 6:
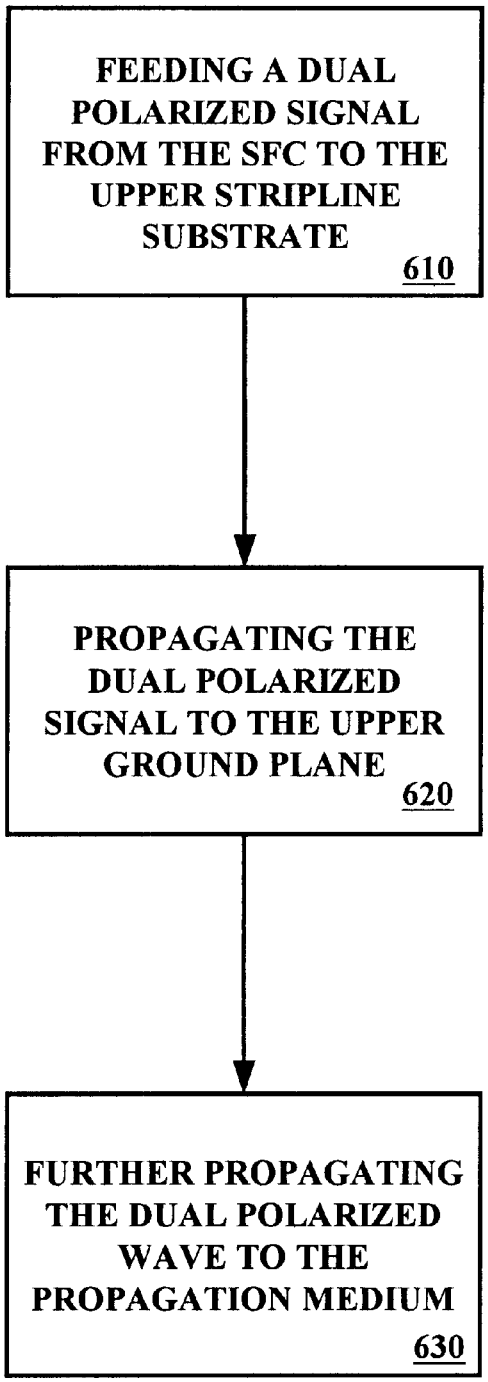
FIG. 6 provides a flowchart illustrating a method for communicating a dual polarized signal in the microstrip antenna system of FIGS. 5A and 5B.

FIG. 6 provides a flowchart illustrating a method for communicating the dual polarized signal in the microstrip antenna system of FIGS. 5A and 5B. The flow chart of FIG. 6 shows the architecture, functionality, and operation of a possible implementation of the method for communicating the dual polarized signal in the microstrip antenna system of FIGS. 5A and 5B. In this regard, each block represents a module, segment, or portion of code, which comprises one or more executable instructions for implementing the specified logical function(s). It should also be noted that in some alternative implementations, the functions noted in the blocks may occur out of the order noted in FIG. 6. For example, two blocks shown in succession in FIG. 6 may in fact be executed substantially concurrently or the blocks may sometimes be executed in the reverse order, depending upon the functionality involved, as will be further clarified hereinbelow.

As shown by block 610, the SFC 512 (FIGS. 5A and 5B) feeds the dual polarized signal to the upper stripline substrate 510 (FIGS. 5A and 5B). In block 620, the upper stripline substrate 510 (FIGS. 5A and 5B) then propagates the dual polarized signal to the upper ground plane 505 (FIGS. 5A and 5B). As shown by block 630, the upper ground plane 505 (FIGS. 5A and 5B) further propagates the dual polarized signal to a propagation medium. The propagation medium can be any medium, including but not limited to an electromagnetic medium at any frequency or any other medium known to people having ordinary skill in the art. Alternatively, a dual polarized signal can be received from the propagation medium by the upper ground plane 505 (FIGS. 5A and 5B). The upper ground plane 505 (FIGS. 5A and 5B) propagates the dual polarized signal to the upper stripline substrate 510 (FIGS. 5A and 5B) that further propagates the dual polarized signal to the SFC 512 (FIGS. 5A and 5B) located in the SFC layer 511 (FIGS. 5A and 5B).

Figure 7:
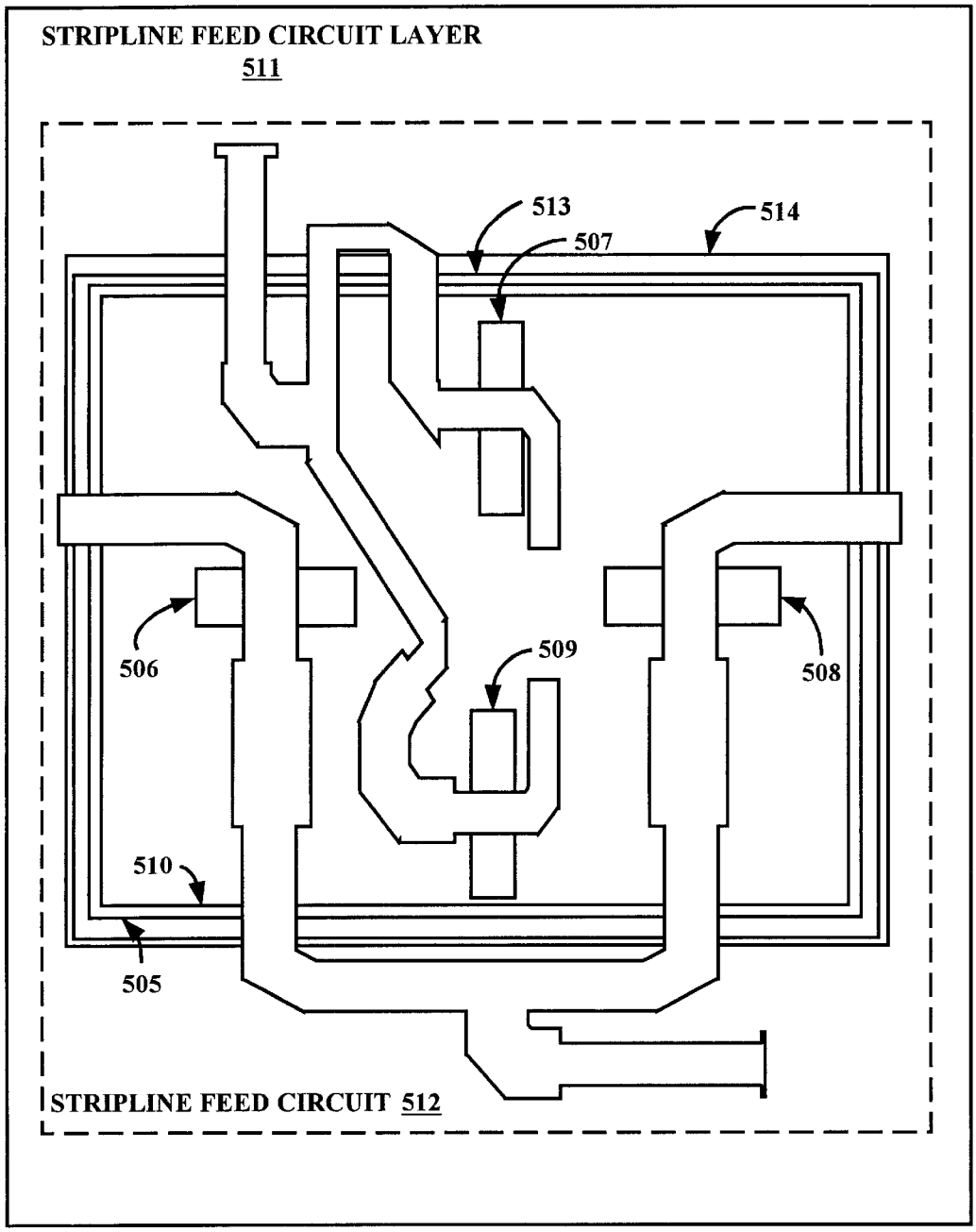
FIG. 7 is a composite top view of the microstrip antenna system of FIGS. 5A and 5B.

FIG. 7 is a composite top view of the microstrip antenna system of FIGS. 5A and 5B. The SFC layer 511 comprises the SFC 512. The SFC 512 symmetrically feeds four slots, namely, the first slot 506, the second slot 507, the third slot 508, and the fourth slot 509. The first and third slots 506 and 508 are used for a linear polarization feed, and the second and fourth slots 507 and 509 are used for another linear polarization feed. The upper stripline substrate 510 is located above the SFC layer 511 and below the upper ground plane 505. A lower stripline substrate 513 is located between the SFC layer 511 and above the lower ground plane 514.

Some applications of the microstrip antenna system of FIGS. 4A, 4B, 5A, 5B, and 7, include, but are not limited to, commercial applications, or Department of Defense applications. For instance, the microstrip antenna system of FIGS. 4A, 4B, 5A, 5B, and 7, can be used to communicate dual polarized signals between a commercial or a military aircraft and a satellite system. However, the microstrip antenna system of FIGS. 4A, 4B, 5A, 5B, and 7, would be well suited to many current and planned commercial communication antennas, especially for Cell site base stations for Public Communication Systems (PCS).

The above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A microstrip antenna system, comprising:

a lower stripline substrate;

an upper stripline substrate;

a stripline feed circuit layer located between the lower stripline substrate and the upper stripline substrate;

a lower ground plane located below the lower stripline substrate; and an upper ground plane located above the upper stripline substrate, wherein the microstrip antenna system reduces backward radiation, and wherein the upper ground plane comprises a first slot, a second slot, a third slot, and a fourth slot to allow dual polarization of a signal, the second slot located in a clockwise direction and orthogonal to the first slot, the third slot located in a clockwise direction and orthogonal to the second slot, and the fourth slot located in a clockwise direction and orthogonal to the third slot.

2. The microstrip antenna system of claim 1, wherein the upper ground plane comprises a first slot, a second slot, a third slot, and a fourth slot to allow dual polarization of a signal, the second slot located in a clockwise direction and orthogonal to the first slot, the third slot located in a clockwise direction and orthogonal to the second slot, and the fourth slot located in a clockwise direction and orthogonal to the third slot.

3. The microstrip antenna system of claim 1, wherein a lower microstrip substrate is located above the upper ground plane, a lower microstrip patch antenna is located above the lower microstrip substrate, the lower microstrip patch antenna is a first resonant structure, and the lower microstrip substrate and the upper ground plane improve efficiency of the lower microstrip patch antenna.

4. The microstrip antenna system of claim 3, wherein an upper microstrip substrate is located above the lower microstrip patch antenna, an upper microstrip patch antenna is located above the upper microstrip substrate, the upper microstrip patch antenna is a second resonant structure, and the upper microstrip substrate improves efficiency of the upper microstrip patch antenna.

5. The microstrip antenna system of claim 1, wherein a lower microstrip substrate is located above the upper ground plane, a lower microstrip patch antenna is located above the lower microstrip substrate, an upper microstrip substrate is located above the lower microstrip patch antenna, an upper microstrip patch antenna is located above the upper microstrip substrate, the lower microstrip patch antenna is a first resonant structure, the upper microstrip patch antenna is a second resonant structure, and the upper ground plane, the lower microstrip substrate, and the upper microstrip substrate improves efficiency of the lower and the upper microstrip patch antennas.

6. The microstrip antenna system of claim 1, wherein the upper stripline substrate has a different thickness than the lower stripline substrate.

7. The microstrip antenna system of claim 1, wherein the upper stripline substrate is less thick than the lower stripline substrate.

8. The microstrip antenna system of claim 1, wherein, the upper stripline substrate has same thickness as the lower stripline substrate.

9. The microstrip antenna system of claim 1, wherein the upper stripline substrate has a different dielectric constant than the lower stripline substrate.

10. The microstrip antenna system of claim 1, wherein the upper stripline substrate has same dielectric constant as that of the lower stripline substrate.

11. A method for communicating a dual polarized signal in a microstrip antenna system, comprising the steps of:

feeding the dual polarized signal from a stripline feed circuit layer to an upper stripline substrate; and propagating the dual polarized signal from the upper stripline substrate to an upper ground plane, wherein the stripline feed circuit layer is located between the upper stripline substrate and a lower stripline substrate, the upper ground plane is located above the upper stripline substrate, and a lower ground plane is located below the lower stripline substrate, wherein the upper ground plane has a first slot, a second slot, a third slot, and a fourth slot, and wherein the second slot is located orthogonal to and in a clockwise direction of the first slot, the third slot is located orthogonal to and in a clockwise direction of the second slot, and the fourth slot is located orthogonal to and in a clockwise direction of the third slot.

12. The method of claim 11, wherein the upper ground plane has a first slot, a second slot, a third slot, and a fourth slot, wherein the second slot is located orthogonal to and in a clockwise direction of the first slot, the third slot is located orthogonal to and in a clockwise direction of the second slot, and the fourth slot is located orthogonal to and in a clockwise direction of the third slot.

13. The method of claim 11, further comprising the steps of:

communicating the dual polarized signal from the upper ground plane to a lower microstrip substrate that is located above the upper ground plane, and further communicating the dual polarized signal from the lower microstrip substrate to a lower microstrip patch antenna located above the lower microstrip substrate.

14. The method of claim 13, further comprising the steps of communicating the dual polarized signal from the lower microstrip patch antenna to an upper microstrip substrate that is located above the lower microstrip patch antenna, and further communicating the dual polarized signal from the upper microstrip substrate to an upper microstrip patch antenna located above the upper microstrip substrate.

15. The method of claim 11, wherein the stripline feed circuit layer is located between the upper stripline substrate and a lower stripline substrate, the upper ground plane is located above the upper stripline substrate, and a lower ground plane is located below the lower stripline substrate.

16. The method of claim 11, wherein the upper stripline substrate has a different thickness than the lower stripline substrate.

17. The method of claim 11, wherein the upper stripline substrate is less thick than the lower stripline substrate.

18. The method of claim 11, wherein the upper stripline substrate has same thickness as the lower stripline substrate.

19. The method of claim 11, wherein the lower stripline substrate has a different dielectric constant than the upper stripline substrate.

20. The method of claim 11, wherein the lower stripline substrate has same dielectric constant as the upper stripline substrate.

21. A method for communicating a dual polarized signal in a microstrip antenna system, comprising the steps of:

receiving a dual polarized signal in an upper ground plane;

propagating the dual polarized signal from the upper ground plane to an upper stripline substrate that is located below the upper ground plane; and further propagating the dual polarized signal from the upper stripline substrate to a stripline feed circuit layer, wherein the stripline feed circuit layer is centered above a lower stripline substrate, the lower stripline substrate located above a lower ground plane, wherein the upper ground plane has a first slot, a second slot, a third slot, and a fourth slot, and wherein the second slot is located orthogonal to and in a clockwise direction of the first slot, the third slot is located orthogonal to and in a clockwise direction of the second slot, and the fourth slot is located orthogonal to and in a clockwise direction of the third slot.

22. A microstrip antenna system, comprising:

means for feeding a dual polarized signal from a stripline feed circuit layer to an upper stripline substrate; and means for propagating the dual polarized signal from the upper stripline substrate to an upper ground plane, wherein the stripline feed circuit layer is located between the upper stripline substrate and a lower stripline substrate, the upper ground plane located above the upper stripline substrate, and a lower ground plane located below the lower stripline substrate, wherein the upper ground plane has a first slot, a second slot, a third slot, and a fourth slot, the second slot being located orthogonal to and in a clockwise direction of the first slot, the third slot being located orthogonal to and in a clockwise direction of the second slot, and the fourth slot being located orthogonal to and in a clockwise direction of the third slot.

23. The microstrip antenna system of claim 22, wherein the upper ground plane has a first slot, a second slot, a third slot, and a fourth slot, the second slot being located orthogonal to and in a clockwise direction of the first slot, the third slot being located orthogonal to and in a clockwise direction of the second slot, and the fourth slot being located orthogonal to and in a clock-wise direction of the third slot.

24. The microstrip antenna system of claim 22, further comprising:

means for communicating the dual polarized signal from the upper ground plane to a lower microstrip substrate that is located above the upper ground plane; and means for further communicating the dual polarized signal from the lower microstrip substrate to a lower microstrip patch antenna located above the lower microstrip substrate.

25. The microstrip antenna system of claim 24, further comprising:

means for communicating the dual polarized signal from the lower microstrip patch antenna to an upper microstrip substrate located above the lower microstrip patch antenna; and means for further communicating the dual polarized signal from the upper microstrip substrate to an upper microstrip patch antenna located above the upper microstrip substrate.

26. The microstrip antenna system of claim 22, wherein the upper stripline substrate has a different thickness than the lower stripline substrate.

27. The microstrip antenna system, of claim 22, wherein the upper stripline substrate is less thick than the lower stripline substrate.

28. The microstrip antenna system of claim 22, wherein the upper stripline substrate has same thickness as the lower stripline substrate.

29. The microstrip antenna system, of claim 22, wherein the lower stripline substrate has a different dielectric constant than the upper stripline substrate.

30. The microstrip antenna system of claim 22, wherein the lower stripline substrate has same dielectric constant as the upper stripline substrate.

31. A microstrip antenna system, comprising:

means for receiving a dual polarized signal in an upper ground plane;

means for propagating the dual polarized signal from the upper ground plane to an upper stripline substrate that is located below the upper ground plane; and means for further propagating the dual polarized signal from the upper stripline substrate to a stripline feed circuit layer, wherein the stripline feed circuit layer is centered above a lower stripline substrate, and the lower stripline substrate is located above a lower ground plane, wherein the upper ground plane has a first slot, a second slot, a third slot, and a fourth slot, the second slot being located orthogonal to and in a clockwise direction of the first slot, the third slot being located orthogonal to and in a clockwise direction of the second slot, and the fourth slot being located orthogonal to and in a clockwise direction of the third slot.

* * * * *